United States Patent [19]

Thomson

[11] Patent Number: 4,536,020

[45] Date of Patent: Aug. 20, 1985

[54] MARINE DOOR LOCKSET

[76] Inventor: Daniel C. Thomson, 5396 South Langley Rd., Langley, Wash. 98260

[21] Appl. No.: 352,926

[22] Filed: Feb. 26, 1982

[51] Int. Cl.[3] ..... E05C 1/16

[52] U.S. Cl. ..... 292/173

[58] Field of Search ..... 292/DIG. 38, DIG. 51, 292/359, 150, 173, 143, 175, 140; 70/467, 470, 487, 150

[56] References Cited

U.S. PATENT DOCUMENTS

| | | | |
|---|---|---|---|
| 365,281 | 6/1887 | Thornd | 292/221 |
| 453,895 | 6/1891 | Angell | 292/150 |
| 471,118 | 3/1892 | Higgins | 292/150 X |
| 551,974 | 12/1895 | Kubec | 292/143 |
| 692,068 | 1/1902 | Patrick | 292/359 |
| 1,786,521 | 12/1930 | Dermody | 292/173 X |
| 2,073,149 | 3/1937 | Geyer | 292/DIG. 38 |
| 2,795,445 | 6/1957 | Beil | 292/140 |
| 2,936,606 | 5/1960 | Welch et al. | 292/140 X |
| 3,179,459 | 4/1965 | Lint | 292/356 |
| 3,952,565 | 4/1976 | Falk | 70/417 |

FOREIGN PATENT DOCUMENTS

| | | | |
|---|---|---|---|
| 45914 | 1/1911 | Austria | 292/150 |

*Primary Examiner*—Richard E. Moore

*Attorney, Agent, or Firm*—Ward Brown; Robert W. Beach

[57] ABSTRACT

A lockset includes a casing, a bolt, a spindle which can be turned for reciprocating the bolt, and a slide bar for locking the latch bolt and the spindle which are all made of stainless steel. The bolt is slidably received in a housing made of plastic such as nylon or acetal plastic which is mounted in a casing and located by positioning posts projecting from one side wall of the casing. The spindle carries a lever arm engageable with a pin projecting from the bolt to reciprocate it by turning of the spindle and a side plate of the casing has in it an aperture large enough for movement of an end portion of the spindle and the lever arm through it. The slide bar can be slid between a locking position in which it blocks reciprocation of the bolt and turning of the spindle and a released position, and such slide bar can be moved selectively either by a key lock or by a manually manipulated pin.

13 Claims, 4 Drawing Figures

MARINE DOOR LOCKSET

BACKGROUND OF THE INVENTION

1. Field of the Invention

The present invention relates to lockset mechanism for a closure member openable relative to a frame member and particularly adapted for use in a swinging door subjected to a marine environment.

2. Prior Art

Marine door locksets commonly are formed of metal components which, unavoidably, are subject to humid salty sea air which promotes corrosion. For locks used infrequently, the moving parts can become frozen in one position, or the operation of the locks can become stiff, necessitating replacement or at least frequent lubrication or maintenance.

It is known, of course, that some metals are more corrosion resistant than others. Nevertheless, without prohibitive expense only a few metals can be used in forming the components of known locksets containing a large number of parts, some of which are small and/or of complicated shape. To reduce expense, the various parts have been formed from metals such as brass, which are easily cast or soft enough to be machined easily but which are quite corrodible in damp air.

For example, one known lockset used in a swinging marine door has a rectangular brass casing fitable in a mortise in an edge portion of the door. The interior of the lock casing is of complicated shape for receiving the various cams, followers, levers and other parts used to actuate movement of a dead bolt and a separate latch bolt. While the bolts are chrome plated, presumably because they are projectable from the casing directly into the sea air, such internal working parts, like the lock casing, are of brass. In time the intrusion of sea air into the interior of the casing can cause the various brass parts and the casing itself to corrode, and the chrome plating of the separate bolts can be worn off by rubbing of the bolts against the other metal parts.

Use of different metals in a marine door lockset also can cause galvanic corrosion. The humid salty sea air acts as an electrolyte between different metals in close proximity to each other with the result that the more anodic metal is gradually eaten away. Such corrosion can be a substantial problem where the lockset is used in a conventional marine door having a wooden core and a skin of aluminum alloy sheet material because aluminum is highly subject to galvanic corrosion. If a lockset casing or other parts of the lockset containing brass, bronze, nickel or chromium, for example, are in close proximity to the aluminum skin, the skin will be eaten away in the area of its proximity to the lockset parts.

SUMMARY OF THE INVENTION

It is an object of the present invention to provide a sturdy, reliable, substantially tamperproof lockset for a closure member openable relative to a frame member and adapted for use in a swinging marine door.

In accordance with the above object, it is an object to provide such a lockset having component parts of highly corrosion resistant materials.

An additional object is to provide such a lockset using few parts of uncomplicated shape enabling the lockset parts to be machined economically or stamped from hard metal such as stainless steel and which are strong.

A further object is to provide such a lockset in which all the metal parts are formed from the same metal and in which, when installed in a door, the metal parts are substantially isolated from any of the door parts of a different metal so as to deter galvanic corrosion.

Another object is to provide such a lockset of a construction which does not require frequent lubrication or maintenance.

Yet another object is to provide such a lockset composed of parts that can be quickly and easily assembled and installed.

The foregoing objects can be accomplished by providing a stainless steel lock casing in which are mounted the latch bolt reciprocated by a lever arm mounted on a handle-rotated spindle. The latch bolt can be locked against reciprocation by a slide bar and the spindle can be locked against turning by the toe of such slide bar. Such slide bar can be incorporated in a night latch, being reciprocated selectively by a key-operated cylinder lock accessible from the outside of the door and by a slider accessible from the inner side of the door.

DETAILED DESCRIPTION

Figure 1:
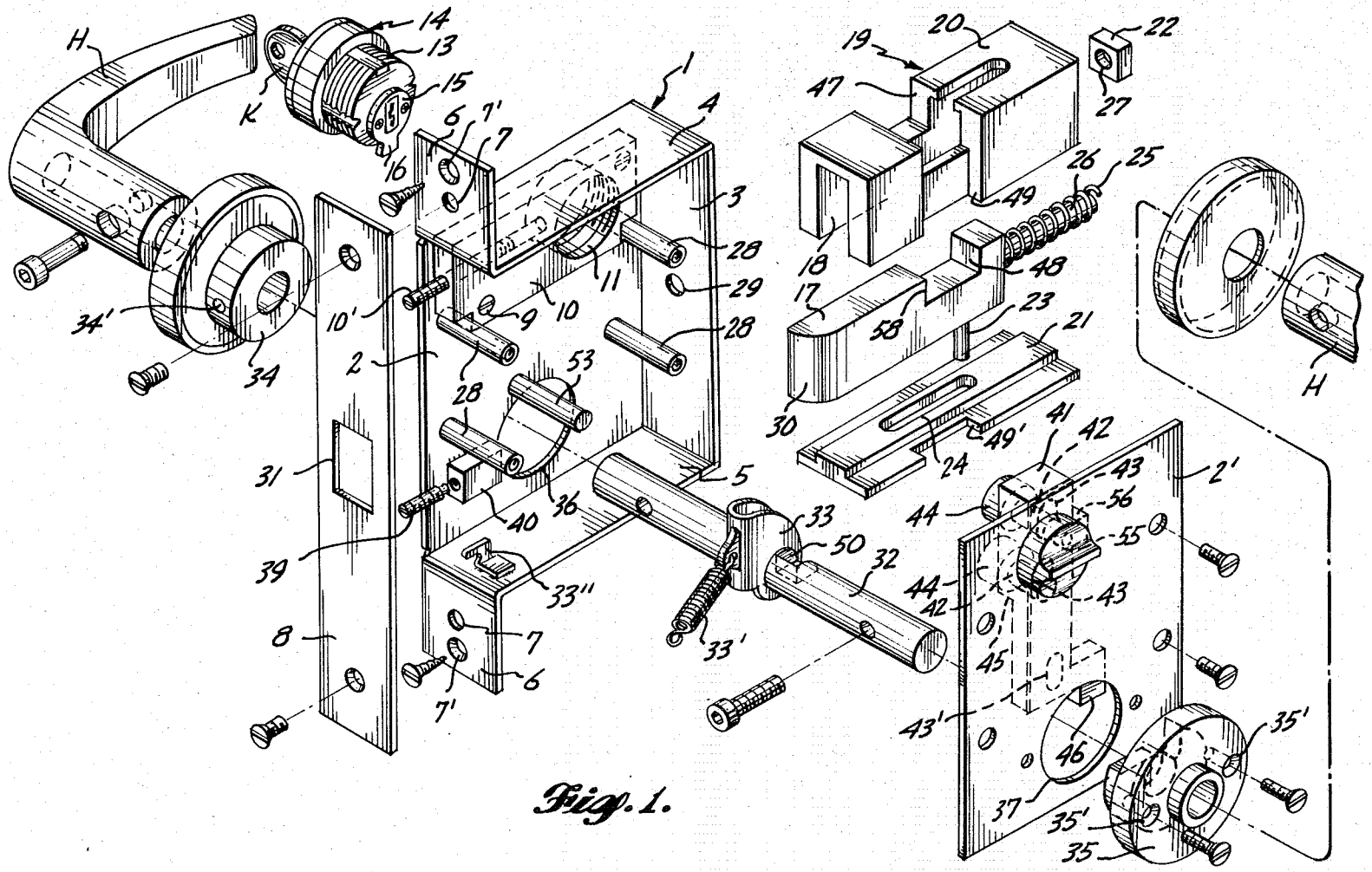
FIG. 1 is a top perspective of a lockset in accordance with the present invention with parts shown in exploded relationship.
Figure 2:
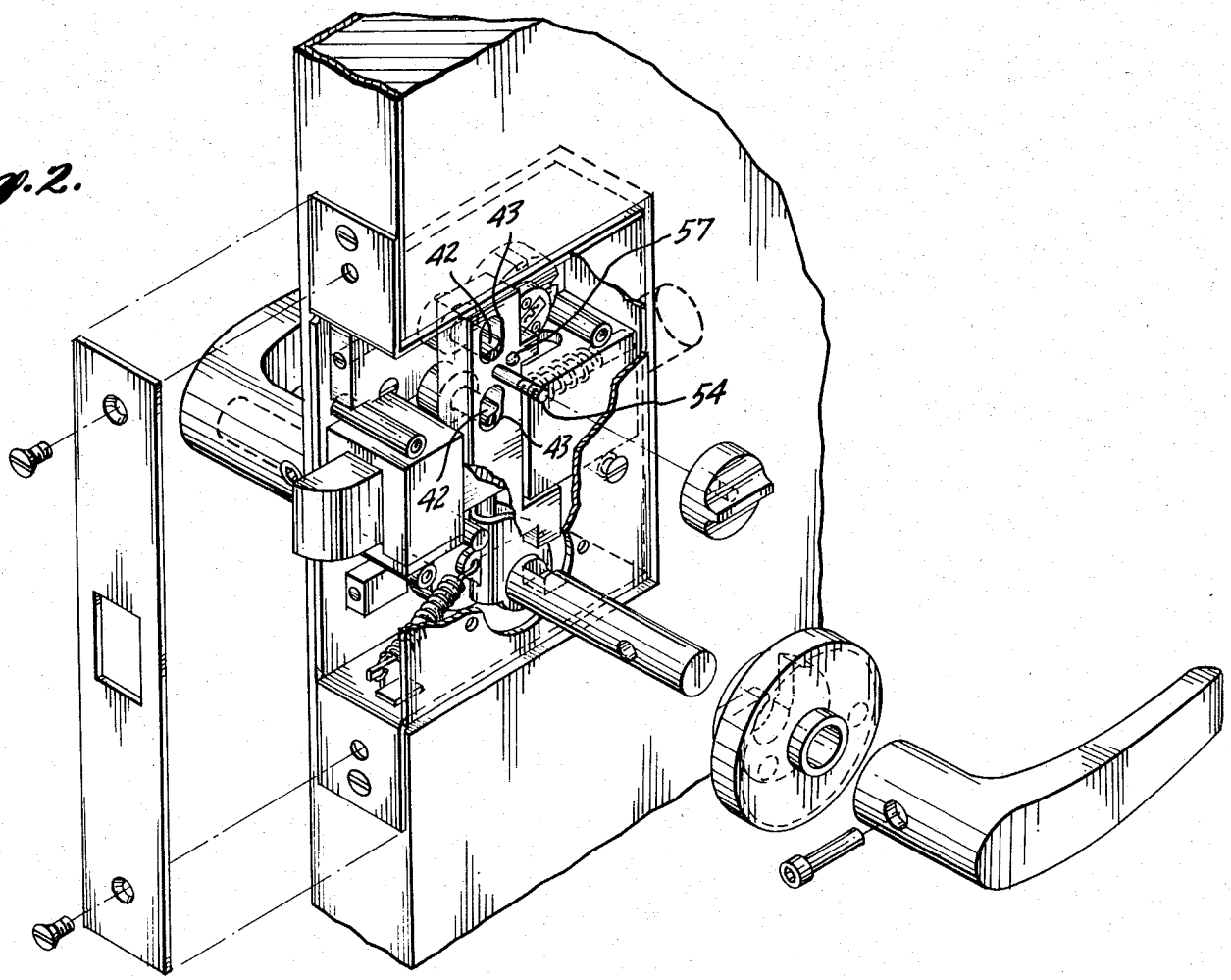
FIG. 2 is a fragmentary top perspective of an upright edge portion of a swinging marine door having installed in it a lockset in accordance with the present invention, parts being broken away and parts being shown in exploded relationship.

As shown in FIG. 1, the preferred embodiment of a lockset in accordance with the present invention includes an outer casing of metal plate material. Such casing includes a box 1, an upright side plate 2 with a backplate 3, top plate 4 and bottom plate 5 bent perpendicular to side plate 2 so as to define the rectangular inner cavity of the casing. Short flanges or ears 6 are bent perpendicularly outward from the front end portions of the top and bottom plates and have apertures 7 for receiving screws mounting a separate casing faceplate 8 to substantially close the front of the casing and apertures 7' for receiving screws securing the lockset to the side of a door. The side of the casing opposite side plate 2 is covered by a removable side plate 2'.

Secured inside the upper portion of the casing side plate 2, such as by machine screws 9 screwed into tapped holes in the side plate 2, is a metal mounting block 10 having toward its rear end an internally threaded aperture 11 registered with an aperture through the upper portion of the casing side plate. The externally threaded shank 13 of a conventional cylinder lock 14 can be screwed into the mounting block aperture 11 for securely mounting the cylinder lock in the casing. A setscrew 10' threaded in the block 10 and engaging a recess in the lock 14 secures the lock in its mounted position. The cylinder lock has a generally axially extending rotor 15 with, at its inner end, a generally radially projecting lug 16. The rotor and its lug are rotatable by turning a key K inserted through the outer end of the rotor.

A latch bolt 17 of rectangular cross section is slidably received in the generally axial, rectangular passage 18 through a rectangular plastic housing 19. Such latch bolt is made of machined stainless steel and is very strong. The housing is made of plastic such as nylon or acetal plastic. Such housing is in three parts including an upper channel-shaped main block 20 forming the top and upright sides of the housing and having a downward opening rectangular slot forming the passage 18. The bottom of the slot is closed by a separate elongated stepped plastic bottom plate 21 having an upper rib to fit in the bottom of the slot. The rear end of the slot is closed by the rectangular plastic end plate 22 fitted between the housing main block 20 and bottom plate 21.

An upright metal bolt-reciprocating pin 23 projects downward from the latch bolt through a fore-and-aft elongated slot 24 in the housing bottom plate 21. A helical compression spring 25 encircles a rod 26 projecting rearward from the tail of the bolt and extending through an aperture 27 in the housing end plate 22. By engagement of its opposite ends against the housing end plate and the tail of the bolt, the spring biases the bolt outward away from the housing end plate.

The latch bolt and housing assembly is mounted inside the outer casing 1 between vertically spaced rows of locating posts 28. Four of such posts are provided arranged to locate two posts in each row. Each post is butt-welded to the casing side plate 2 so as to project perpendicularly inward. Removable side plate 2' is secured to the casing box 1 by screws extending through holes in such side plate and screwed into tapped bores in the free ends of such posts.

When the plastic housing 19 is assembled in the casing 1, an aperture 29 through the casing backplate 3 is registered with the aperture 27 through the latch bolt housing end plate 22 permitting the rearward projecting bolt rod 26 to slide through such registered apertures. Forward sliding of the latch bolt projects its beveled head end portion 30 from the housing passage 18 through the central rectangular aperture 31 of the casing faceplate 8.

Beneath the latch bolt 17 a turnable spindle 32 extends transversely of the bolt and has an upward projecting lever arm 33 for engaging the bolt-reciprocating pin 23 projecting downward from the bolt. Preferably such lever arm has a groove in its rear side for embracing such pin. Such lever arm can be formed by a return bent metal sheet the parallel sides of which are apertured for the spindle to extend through them. The spindle is journaled in plastic stepped bushings 34 and 35 having bosses fitted in apertures 36 and 37, respectively, in the lower portions of the casing side plates 2 and 2'. The flanged portions of such bushings would be located outside the casing and are covered by metal caps. A tension spring 33' is connected between the lever arm 33 and a spring anchor hook 33'' welded to the casing bottom.

The bushing 34 at the same side of the casing as the cylinder lock 14 is retained in position by a setscrew 39 extending through the bore of a block 40 secured inside the casing side plate 2 adjacent to its lower aperture 36, such as by being welded to such side plate. When the setscrew is screwed fully in, its inner end portion extends into a blind bore 34' in a side of the inner end portion of the bushing so that the bushing cannot be pried out of its socket aperture. The bushing 35 can be retained in position relative to the removable side plate 2' by a similar block and setscrew construction. Such setscrew would be accessible through the front opening of the casing closeable by the faceplate 8 after the side plate 2' has been mounted on the casing box and the casing box inserted into a mortise in the edge of a door. Alternatively, the bushing 35 could be secured in the side plate 2' of the lock casing simply by press-fitting the boss of the bushing into the aperture 37.

Turning of the spindle 32 to effect swinging of the lever arm 33 rearward for pushing bolt pin 23 to slide the latch bolt 17 rearward is accomplished by lever handles H secured respectively to the opposite end portions of the spindle projecting outward beyond the lock casing. Such handles can be secured to the spindle by setscrews.

The latch bolt 17 can be locked in projecting position and spindle 32 can be locked against rotation. Such locking is accomplished by lengthwise reciprocation of an upright slide bar 41 slidably mounted on the inner surface of the removable casing side plate 2' by upper and lower guide posts 42. Such guide posts are butt-welded to the inner side of the side plate in positions projecting perpendicularly inward in a vertical plane. Such guide posts extend through elongated upright slots 43 in the slide bar. Heads 44 of the guide posts retain the slide bar on the casing side plate. A further slot 43' receives the end of post 53 to insure linear reciprocation of the bar 41. Preferably a thin sheet of slippery plastic material, such as polytetrafluoroethylene, is interposed between the adjacent surfaces of the slide bar 41 and the side plate 2'. The posts 42 are located on the casing side plate and the slots 43 are located in the slide bar 41 in positions to locate the slide bar toward the front of the casing from the cylinder lock 14 and spindle 32.

The locking slide bar 41 includes a downward-facing shoulder 45 which divides the bar into a thicker upper portion disposed alongside the lock-mounting block 10 and a thinner lower portion extending along one lateral side and below the latch bolt housing 19 and terminating in a downward projecting toe 46 offset rearwardly from the main body of the bar. The thicker upper end portion of the bar is slidable up and down through a transverse notch 47 in the upper side of the bolt housing 19 down into and up out of a rectangular transverse notch 48 in the upper side of the bolt. The thinner lower portion of the slide bar 41 slides through an upright slot 49 in the side of the latch bolt housing and a notch 49' in the edge of bottom housing plate 21.

Figure 4:
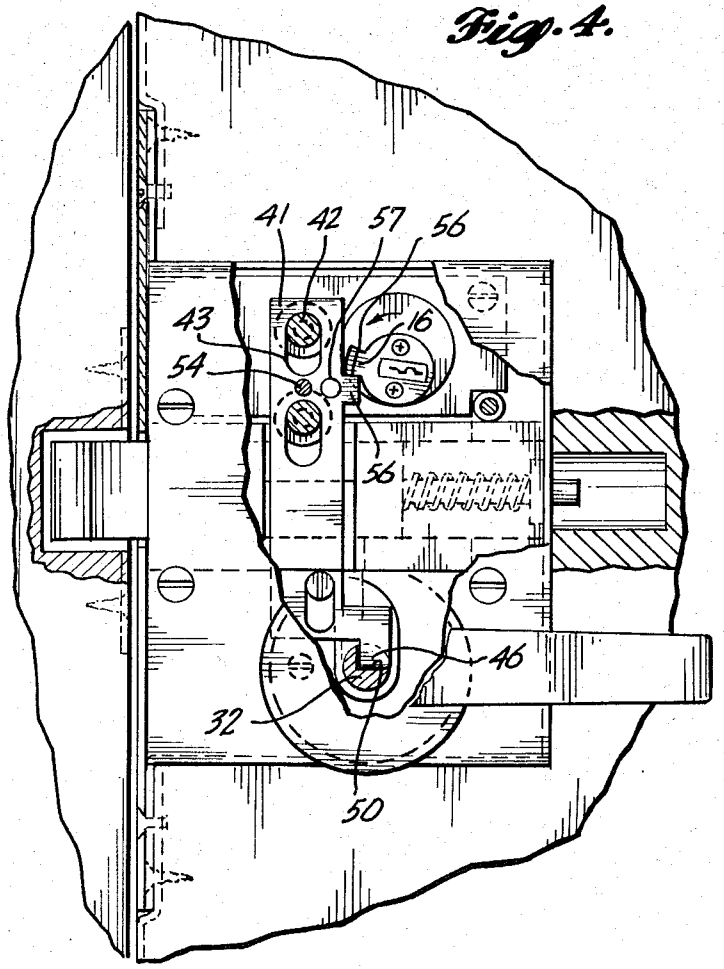
FIGS. 3 and 4 are corresponding fragmentary side elevations of an edge portion of a swinging marine door mounted in a frame and having installed in it a lockset in accordance with the present invention, each with parts broken away, but showing parts in different positions.

Spindle 32 has a quadrant notch 50 in it alongside lever arm 33 located in alignment with the toe 46 of the slide bar. This toe is of a length such that when the bar is in its lowest position the toe will fit into the notch of the spindle as shown in FIG. 4 to lock the spindle against rotation. The spindle is normally held in such position by the tension spring 33' connected between the lever arm 33 and the spring anchor hook 33'' which urges the lever arm to swing toward the front of the casing. Swinging of the lever arm in such direction is limited by engagement of its swinging end with post 53 which is butt-welded to the casing side plate 2 and projects inward perpendicular to it.

For manually reciprocating the slide bar 41 up and down from inside the door, an actuating pin 54 projects outward from the slide bar through an upright slot 55 in the casing side plate 2'. To effect key-actuated reciprocation of the slide bar from outside the door, a lug 56 projects rearward from the upper portion of the bar and is disposed in the path of movement of the lug 16 projecting radially outward from the inner end of the rotor 15 of the cylinder lock 14. A spring-pressed ball detent 57 mounted in an aperture in the slide bar and having a spring-loaded ball engageable in depressions or holes in the casing side plate 2' releasably holds the slide bar 41 in either its down locking position or its up released position.

In the down locking position of the slide bar 41, not only is its upper thicker portion engaged behind the leading end 58 of the latch bolt notch 48, but also the toe 46 of the slide bar is engaged in the notch 50 in the lock spindle 32 so as to prevent rotation of the spindle tending to swing its lever arm 33 rearward for effecting inward reciprocation of the latch bolt. The inner end portion of the spindle bushing 35 is notched so as to enable elevational travel of the toe of the slide bar alongside such bushing.

The lockset parts are assembled from their exploded relationship shown in FIG. 1 by securing the rear wall 22 of the latch bolt housing 19 in place in such housing such as by adhesive. Compression spring 26 is then slid over pin 25 projecting rearward from bolt 17 and such bolt is inserted into slot 18 of the bolt housing and moved rearward until rod 25 extends through aperture 27 in rear wall 22. The lower plate 21 of the bolt housing can then be assembled with such housing with the pin 23 projecting through slot 24 in such bottom plate and secured in place such as by adhesive.

Figure 3:
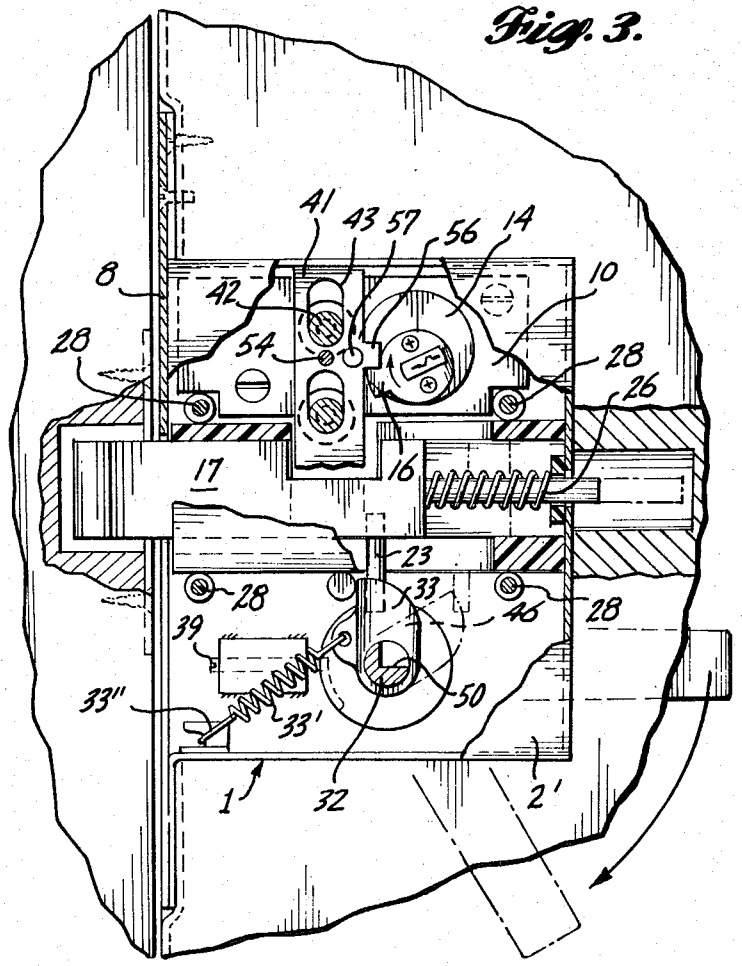

Next, the latch bolt assembly can be assembled into the casing 1 between the locating posts 28 as shown in FIG. 3. The cylinder lock 14 can then be screwed into the block 10 and secured by the setscrew 10'. Spring 33' can be connected between the lever arm 33 and the spring anchor 33''. The casing side plate 2' can now be assembled onto the casing box 1 and secured in place by the screws anchored in posts 28. The casing is then ready for installation in a door edge mortise and is secured to the edge of the door by screws inserted through holes 6' in ears 7'.

The casing apertures 36 and 37 are large enough so that the lever arm 33 of spindle 32 can be inserted through either of them. One end portion of the spindle 32 and the lever arm 33 can therefore be inserted through one of such apertures and the lever arm groove engaged with the bolt pin 23. The bushings 34 and 35 are slid over the respective projecting ends of the spindle 32 and their bosses are inserted into the casing apertures 36 and 37. Setscrew 39 can then be inserted to hold bushing 34 in place. Bushing 35 can be secured to casing end plate 2' either by a press fit or by a setscrew. It is secured to the adjacent side of the door by screws extending through apertures 35' in the plastic bushing case before the metal cap is installed over such core to conceal such screws.

With the internal lock mechanism thus assembled the faceplate 8 can be attached to the ears 6 and 7 and the handles H can be applied and secured onto the ends of the spindle 32 by setscrews.

With the lock thus assembled, swinging of either handle will effect turning of spindle 32 to swing lever arm 33 rearward for pushing lock bolt pin 23 inward to reciprocate the latch bolt in opposition to the outward force exerted on it by compression spring 26 for retracting the outer end of the latch bolt into the lock casing. When the handle is released, the spring 33' will return the lever arm 33 to its upright position and spring 26 will reciprocate the latch bolt to project its outer end into door-holding position.

If it is desired to lock the lock mechanism manually from inside, rod 54 is moved downward in slot 55 to slide bar 41 downward to the position shown in FIG. 4 for simultaneously projecting its shoulder 45 into the notch 48 in the upper side of the latch bolt 17 and its toe 46 into the quadrant notch 50 of the spindle 32 both to lock the latch bolt against inward reciprocation and the spindle 32 against turning in either direction. The latch bolt and spindle can be unlocked by raising pin 54 to slide bar 41 upward for raising its shoulder out of the latch bolt notch 48 and its toe 46 out of the spindle quadrant notch 50.

If it is desired to lock the latch bolt with the key-operated cylinder lock from outside, the key is turned to swing lug 16 in the direction to press projection 56 of the slide bar 41 downward, as shown in FIG. 4, so that again the slide bar is in its lower latching position. To unlock the lock mechanism with the cylinder lock, the key is turned in the opposite direction to swing lug 16 upward beneath projection 56 so as to raise the slide bar into the position shown in FIG. 3.

I claim:

1. In lock mechanism for a closure member having a mortise in an edge thereof and swingably mountable in a frame member, said lock mechanism including a casing fitable in the closure member mortise, a latch bolt having a head end and a tail end and reciprocable in the casing between a latched position in which the head end portion of the bolt projects from the edge of the closure member to block opening movement of the closure member relative to the frame member and an unlatched position in which the head end of the bolt is retracted toward the edge of the closure member for enabling opening movement thereof, such latch bolt having a shoulder inside the casing and facing the tail end of such bolt, and a spindle and means operatively connecting the spindle and the latch bolt for effecting reciprocation of the latch bolt by turning of the spindle, the improvement comprising the combination of lock means movable, when the latch bolt is in its latched position, between a locking position in which a portion of said lock means is disposed closely behind the bolt shoulder for blocking retraction of the bolt and an unlocked position in which said lock means portion is offset from the path of movement of said bolt shoulder for enabling retraction of the bolt, and means for mounting said lock means inside the casing for movement generally linearly, transversely of the path of reciprocation of the latch bolt shoulder, between said locking and unlocked positions of said lock means, the spindle having means engageable with a portion of the lock means, when a portion of the lock means is disposed closely behind the bolt shoulder, for limiting turning of the spindle.

2. In the lock mechanism defined in claim 1, the lock means including an elongated slide bar, and the mounting means mounting said slide bar for sliding movement lengthwise in a path extending transversely of the spindle.

3. In lock mechanism for a closure member swingably mountable in a frame member including a latch bolt having a head end and a tail end and reciprocable between a latched position in which the head end portion of the bolt projects beyond an edge of the closure member to block opening movement of the closure member relative to the frame member and an unlatched position in which the head end of the bolt is retracted toward the edge of the closure member for enabling opening movement thereof, a spindle extending transversely of the direction of reciprocation of the latch bolt and means operatively connecting the spindle and the latch bolt for effecting reciprocation of the latch bolt by turning of the spindle, the latch bolt having a shoulder facing the tail end of the bolt, the improvement comprising an elongated slide bar having its length extending transversely of the path of movement of the latch bolt shoulder and transversely of the spindle, said slide bar being slidable lengthwise between a locking position in which a portion of said slide bar is disposed closely behind said bolt shoulder for blocking retraction of the bolt and an unlocked position in which said slide bar portion is offset from the path of movement of said bolt shoulder for enabling retraction of the bolt, and the spindle having means engageable with another portion of said slide bar when it is in its locking position such that said slide bar locks both the bolt against retraction and the spindle against turning.

4. In lock mechanism for a closure member swingably mountable in a frame member including a latch bolt having a head end and movable between a latched position in which the head end portion of the bolt projects beyond an edge of the closure member to block opening movement of the closure member relative to the frame member and an unlatched position in which the head end of the bolt is retracted toward the edge of the closure member for enabling opening movement thereof and a spindle extending generally laterally of the latch bolt and having means engageable with a portion of the bolt for moving the bolt by rotation of the spindle, the improvement comprising slide bar means having a toe portion movable transversely of the spindle, and the spindle having a quadrant notch aligned with the path of movement of said toe portion, and means mounting said slide bar means for movement between a locked position in which said toe portion is engaged in said quadrant notch of the spindle for blocking turning of the spindle and an unlocked position in which said toe portion is withdrawn from said quadrant notch of the spindle for enabling the spindle to turn.

5. Lock mechanism for a swinging door having a mortise in an upright edge portion thereof comprising:

a metal casing fitable in the door mortise and having a bolt aperture in an edge thereof;

a bolt housing of plastic material received in said casing and having a generally horizontal elongated slot aligned with said bolt aperture and a notch in a horizontal side thereof opening into said slot;

a metal latch bolt fitted in said slot of said bolt housing and slidable therein between a latched position in which a portion of said latch bolt projects through said casing bolt aperture and an unlatched position in which said latch bolt is substantially retracted into said casing; and lock means having a portion movable through said bolt housing notch for engagement by said latch bolt when said latch bolt is in its latched position for blocking retraction of said latch bolt.

6. Lock mechanism for a swinging door having a mortise in an upright edge portion thereof comprising:

a metal casing fitable in the door mortise and having a bolt aperture in an edge thereof;

a bolt housing of plastic material received in said casing and having a generally horizontal elongated slot aligned with said bolt aperture and a notch in a horizontal side thereof opening into said slot;

a metal latch bolt fitted in said slot of said bolt housing and slidable therein between a latched position in which a portion of said latch bolt projects through said casing bolt aperture and an unlatched position in which said latch bolt is substantially retracted into said casing, said latch bolt having an upright actuating projection;

means biasing the latch bolt to its latched position;

lever means engageable with said latch bolt actuating projection and movable for retracting said latch bolt to its unlatched position; and lock means having a portion movable through said bolt housing notch for engagement by said latch bolt when said latch bolt is in its latched position for blocking retraction of said latch bolt.

7. In lock mechanism, a casing, a bolt received in and reciprocable relative to the casing and a spindle extending through the casing transversely of the direction of reciprocation of the bolt, the improvement comprising the bolt having a pin projecting therefrom transversely of the direction of reciprocation of the bolt, and the spindle having a reverse bent metal plate lever arm mounted thereon and forming a groove for receiving said bolt pin to effect reciprocation of the bolt by turning the spindle.

8. Lock mechanism for a swinging closure member having a mortise in an upright edge thereof comprising a casing fitable in the mortise and having opposite upright side plates, a bolt reciprocable in said casing, a spindle extending through said casing side plates transversely of the direction of reciprocation of said bolt, a lever arm carried by said spindle inside said casing and engageable with said bolt for effecting reciprocation thereof, at least one of said casing side plates having an aperture sufficiently large for passage of said lever arm therethrough, and a stepped bushing having a bore receiving an end portion of said spindle for positioning said spindle, said bushing having an inner portion of reduced diameter closely received in said side plate aperture and an outer portion of larger diameter engageable against the exterior of the closure member to limit insertion of said bushing into said casing.

9. The lock mechanism defined in claim 8, in which the casing, the bolt and the spindle are all made of stainless steel and the bushing is of plastic material.

10. The lock mechanism defined in claim 9, in which the bushing includes an enlarged portion located exteriorly of the casing and a stainless steel cap covering the exposed portion of the enlarged portion of the bushing.

11. Lock mechanism for a swinging door having a mortise in an upright edge portion thereof comprising:

a casing fitable in the door mortise and having a bolt aperture in an edge thereof;

a bolt housing received in said casing and having a generally horizontal elongated slot aligned with said bolt aperture and a notch in a horizontal side thereof opening into said slot;

a latch bolt fitted in said slot of said bolt housing and slidable therein between a latched position in which a portion of said latch bolt projects through said casing bolt aperture and an unlatched position in which said latch bolt is substantially retracted into said casing; and lock means having a portion movable through said bolt housing notch for engagement by said latch bolt when said latch bolt is in its latched position for blocking retraction of said latch bolt.

12. Lock mechanism for a swinging door having a mortise in an upright edge portion thereof comprising:

a casing fitable in the door mortise and having a bolt aperture in an edge thereof;

a bolt housing received in said casing and having a generally horizontal elongated slot aligned with said bolt aperture and a notch in a horizontal side thereof opening into said slot;

a latch bolt fitted in said slot of said bolt housing and slidable therein between a latched position in which a portion of said latch bolt projects through said casing bolt aperture and an unlatched position in which said latch bolt is substantially retracted into said casing, said latch bolt having an upright actuating projection;

means biasing the latch bolt to its latched position;

lever means engageable with said latch bolt actuating projection and movable for retracting said latch bolt to its unlatched position; and lock means having a portion movable through said bolt housing notch for engagement by said latch bolt when said latch bolt is in its latched position for blocking retraction of said latch bolt.

13. Lock mechanism for a swinging door having a mortise in an upright edge portion thereof comprising:

a casing fitable in the door mortise and having a bolt aperture in an edge thereof, said casing including horizontally spaced, upright side plates and separate positioning posts extending horizontally generally between said side plates, said positioning posts forming two vertically spaced, generally horizontal rows;

a bolt housing received in said casing, said housing having a top and a bottom closely adjacent to said rows of said positioning posts, respectively, for locating said housing in said casing; and a latch bolt closely received in said bolt housing and slidable therein between a latched position in which a portion of said latch bolt projects through said casing bolt aperture and an unlatched position in which said latch bolt is substantially retracted into said housing and said casing.

* * * * *